United States Patent [19]

Mobsby

[11] 4,170,108

[45] Oct. 9, 1979

[54] FUEL INJECTORS FOR GAS TURBINE ENGINES

[75] Inventor: John A. Mobsby, Draycott, England

[73] Assignee: Rolls-Royce Limited, London, England

[21] Appl. No.: 849,660

[22] Filed: Nov. 8, 1977

Related U.S. Application Data

[63] Continuation-in-part of Ser. No. 677,854, Apr. 16, 1976, abandoned.

[30] Foreign Application Priority Data

Apr. 25, 1975 [GB] United Kingdom ..... 17356/75

[51] Int. Cl.[2] ..... F02C 7/22

[52] U.S. Cl. ..... 60/39.74 R; 239/400; 239/404; 239/406

[58] Field of Search ..... 60/39.74 R, 39.74 B, 60/39.71; 239/400, 404, 405, 406

[56] References Cited

U.S. PATENT DOCUMENTS

| | | | |
|---|---|---|---|
| 3,067,582 | 12/1962 | Schirmer | 60/39.71 |
| 3,530,667 | 9/1970 | Bryan | 60/39.74 R |
| 3,703,259 | 11/1972 | Sturgess et al. | 60/39.74 R |
| 3,866,413 | 2/1975 | Sturgess | 60/39.74 R |
| 3,915,387 | 10/1975 | Carvel et al. | 239/400 |
| 3,937,011 | 2/1976 | Carvel et al. | 60/39.74 B |

*Primary Examiner*—Robert E. Garrett

*Attorney, Agent, or Firm*—Cushman, Darby & Cushman

[57] ABSTRACT

A fuel injector for a gas turbine engine consists of a hollow body adapted to be supplied with compressed air and having a number of fuel orifices in the internal surface of the body. An annular member is located inside the body adjacent to the orifices so as to define an annular gap between it and the internal surface of the hollow body. The gap receives fuel from the orifices and has a radial width of 0.015 to 0.020 inches.

9 Claims, 4 Drawing Figures

FUEL INJECTORS FOR GAS TURBINE ENGINES

This application is a continuation-in-part application of my copending application Ser. No. 677,854, filed Apr. 16, 1976, now abandoned.

This invention relates to fuel injectors for gas turbine engines.

One known type of fuel injector for a gas turbine engine consists of a hollow central body and an outer body which at least partly surrounds the central body and defines a flow passage between the central body and the outer body. The flow passage and the central body are supplied with compressed air when the injector is in operation, and the internal surface of the central body, normally known as the swirl chamber, is provided with a supply of fuel from a number of ports formed in the wall of the swirl chamber. The fuel forms into an annulus attached to the internal surface and flows downstream of the swirl chamber and is atomised by the air when it passes out of the swirl chamber to produce usually a conical atomised spray of fuel issuing from the end of the swirl chamber.

It has been found, however, that a true annular form is not always obtained from a number of fuel ports, for example six ports formed in the wall of the swirl chamber and this can result in the atomised spray in this instance consisting of six substantially separate sprays, each of poor atomisation quality, arranged in a conical manner. This is particularly a problem during starting and idling of the engine because of the low air speed travelling through the injector.

It is an object of the present invention to reduce or overcome this problem.

According to an aspect of the present invention a fuel injector for a gas turbine engine comprises a hollow central body, an outer body which at least partly surrounds the central body and defines a flow passage therebetween, the flow passage and the interior of the central body being adapted to be supplied with compressed air, a plurality of fuel ducts each adapted to supply fuel to a respective orifice in the internal surface of the central body, there being mounted within the hollow central body an elongate/annular member located adjacent to the plurality of orifices so as to define an annular gap between it and the internal surface of the central body which gap is adapted to receive a flow of fuel through said orifices, the radial width of the gap being large enough that it does not provide a flow-controlling orifice for the fuel flow, and having a value of 0.015 to 0.020 inches whereby it deforms the separate flows from the orifices into a substantially single annular flow.

Preferably the radial width of the gap is substantially 0.016 inches.

Preferably each duct is arranged at an acute angle to the internal surface of the central body. The ducts may have circular, square or rectangular cross-sections.

Figure 1:
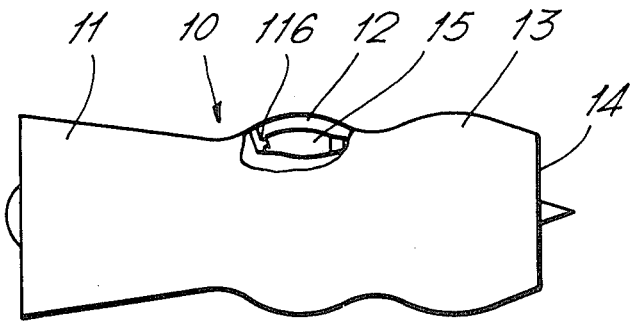
Figure 3:
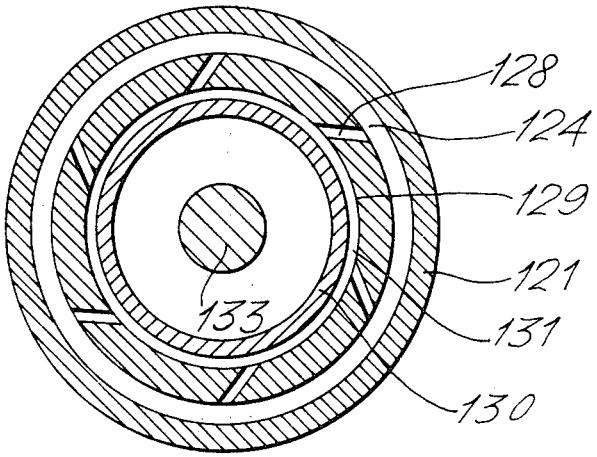
Figure 2:
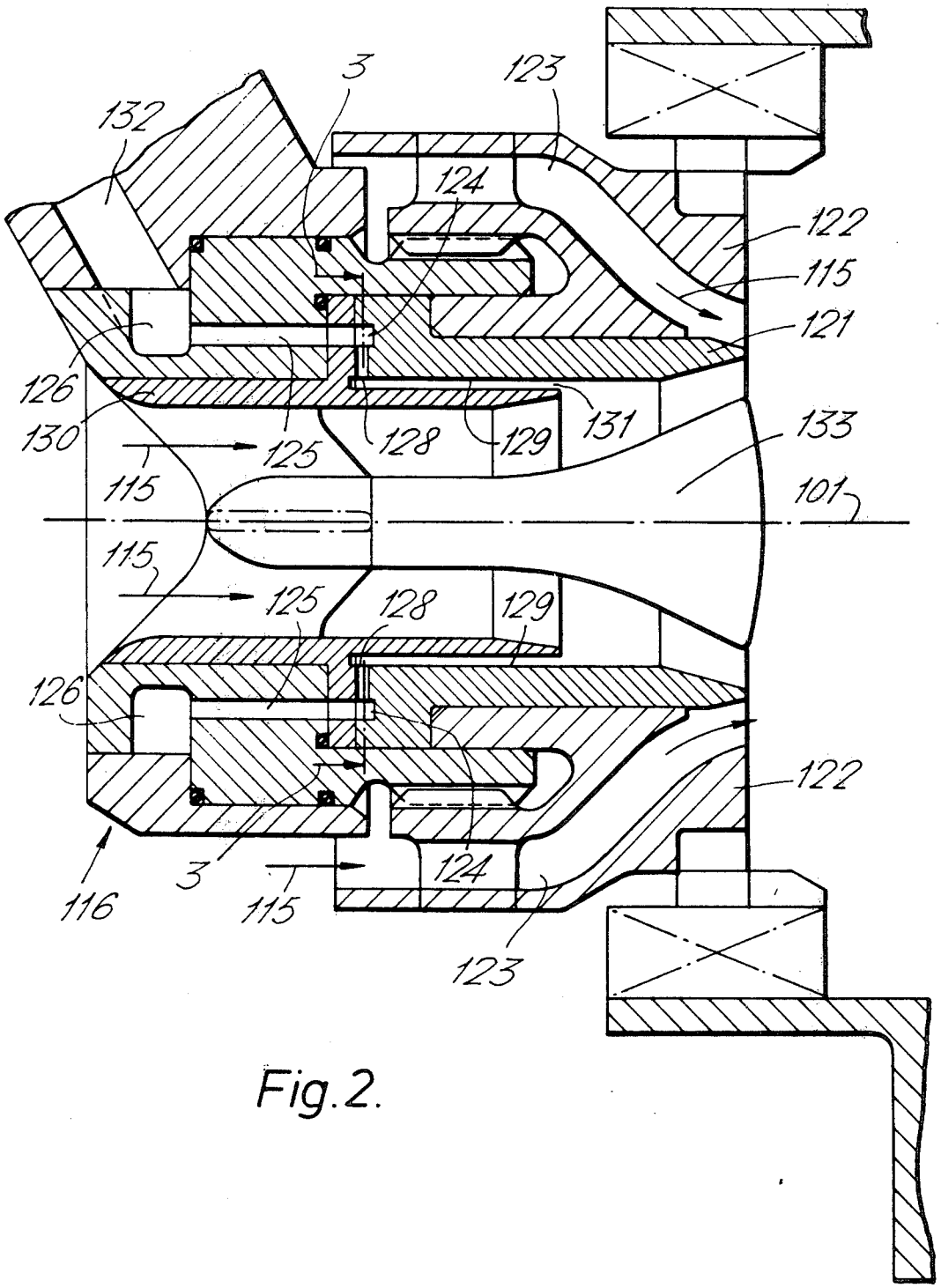
Figure 4:
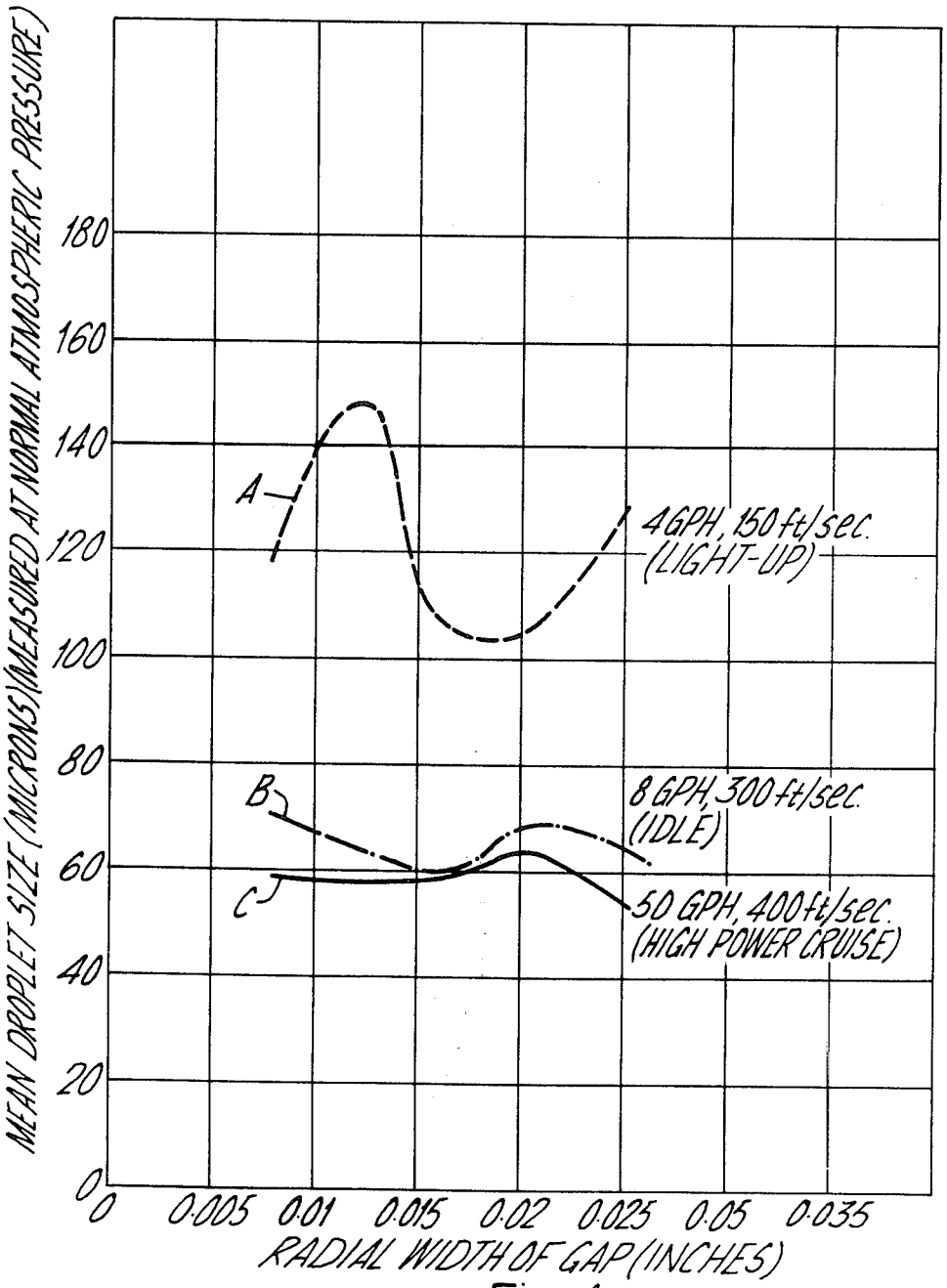

The invention will now be particularly described, merely by way of example, with reference to the accompanying drawings in which:

FIG. 1 is a partly broken-away view of a gas turbine engine having a fuel injector in accordance with the present invention, FIG. 2 is an axial sectional view of the fuel injector of FIG. 1, FIG. 3 is a section on the line 3—3 of FIG. 2, and FIG. 4 is a graph of mean droplet sizes of fuel to a radial gap width at different air velocities and fuel flow rates.

In FIG. 1 there is shown a gas turbine engine 10 having in flow series a compressor section 11, combustion section 12, turbine section 13 and final nozzle 14. The engine as a whole operates in the conventional manner in that air enters the compressor section 11, is compressed and fed to the combustion section 12 where fuel is injected and the resulting mixture is burnt. The exhaust gases then flow through the turbine section 13 and drive the turbine which in turn drives the compressor; the residual gases from the turbine then pass through the nozzle 14 to provide propulsive thrust.

The casing of the engine is cut away in the region of the combustion section to expose to view the combustion chamber comprising a flame tube 15 at the upstream end of which is mounted a fuel injector 116. The flame tube may be annular in which case a plurality of injectors are provided or a number of tubular flame tubes may be provided with one injector for each flame tube.

The or each fuel injector 116 in operation is supplied with compressed air from the compressor means of the engine. Fuel is added in the or each flame tube to the compressed air to form a fuel/air mixture which is then ignited.

FIG. 2 shows a fuel injector 116 in axial cross-section together with the end portion of the flame tube 15.

The flow of air is from the left to the right as indicated in the drawing by arrows 115.

The fuel injector is symmetrical about its longitudinal centre line or axis indicated at 101 and consists of a substantially cylindrical hollow central body 121 mounted in the end of the flame tube 15. An outer body 122 partially surrounds the central body 121 to define an annular flow path 123. In operation compressed air passes through the hollow central body 121 and also through the annular flow path 123.

The internal surface 129 of the central body 121 is provided with six flow controlling orifices 128 which are connected via an annular duct 124 and a number of ducts 125 having a larger flow area than the plurality of orifices 128 to an annular manifold 126. The annular manifold 126 is supplied with fuel from the fuel supply system of the engine from a duct 132.

In the present embodiment the orifices 128 are of square cross-section, but they may in other embodiments have circular, square or rectangular cross-section, and they are arranged to lie with their center lines in a plane perpendicular to the axis 101 and making an acute angle to the surface 129 such that in operation, a swirl is imparted to the fuel which passes around the surface 129. Located within the central body 121 adjacent to the orifices 128 is an elongate sleeve 130. This sleeve forms an annular gap 131 into which the fuel is supplied, between it and the surface 129.

Inside the hollow centre of the body 121 there is also located an air deflector member 133.

The choice of the radial width of the gap 131 is crucial to the operation of the present invention. Thus for reasons discussed below the flow area provided by the gap 131 must be greater than the total flow area of the six flow-controlling orifices 128, and yet the radial width of the gap must be chosen to be small enough to exercise a deforming effect on the six separate flows entering the gap 131 into a substantially single annular flow of fuel on the surface 129. In a particular embodiment it was found that using six square-section orifices 128 whose cross-section is 0.0025 inches×0.025 inches, the radial width of the gap 131 should be 0.016 inches for optimum performance when the diameter of the annular surface was 0.5 inches. This gave an area of annular gap approximately seven times as large as the total area of the orifices 128.

It will be appreciated that for different dimensions, flows and flow areas of the various passages, it will be necessary to choose a different optimum gap 131, but it was found that this optimum must lie between 0.015 inches and 0.02 inches. This is illustrated on FIG. 4 which is a graph of mean droplet sizes (in microns) to the radial width of the gap 131 (in inches) of different air velocities and fuel flow rates.

The graph on FIG. 4 shows three lines, A. B and C, each line indicating the relationship between droplet size and gap width at different fuel flows and air velocities through the hollow centre of the body 121. The line A is for a fuel flow rate of 4 gallons per hour of fuel and an air velocity of 150 ft/sec which are typical values when ignition of the fuel/air mixture takes place on light-up. The line B is for a fuel flow rate of 8 gallons per hour and an air velocity of 300 ft per second which are typical values when an engine is idling and the line C is for a fuel flow rate of 50 gallons per hour at an air velocity of 400 feet per second which are typical values for an engine at a fairly high power condition. It will be seen that the lines B and C are fairly close together, the line C particularly showing a very small droplet size variation. At high air velocities atomisation of the fuel is clearly more easily achieved, and as mentioned earlier atomisation is more difficult with low air velocities as shown by the line A. The line A also shows large variations in droplet size for different sizes of the radial gap 131. The graph shows test results at normal atmospheric pressure, with an aircraft at altitude the atomisation is considerably improved. Thus in practice the line C will be lower with the droplet sizes down to 30 microns.

On studying the line A it will be seen that the best atomisation is achieved with an annular gap size of 0.018 inches, but good atomisation is achieved between 0.015 and 0.02 inches. A gap size less than 0.015 inches produces a rapid deterioration in atomisation as does a gap size of greater than 0.02 inches. The line indicates that good atomisation might be achieved with a gap size approaching 0.005 inches, but this introduces problems in manufacturing since the gas must be precisely annular, any eccentricities in the sleeve considerably distorting the fuel/air mixture emanating from the injector. A gap size of about 0.0025 inches anyway would cause the gap to become a metering orifice which is very undesirable in the context of the present invention.

Line B indicates optimum sizes of gap of 0.016 inches and above 0.025 inches. A gap size of above 0.025 inches would however give very poor atomisation in the light-up condition of the engine. Since the atomisation does not vary much between 0.015 and 0.02 inches this range of values is therefore particularly suitable for light-up and idle conditions. Similarly on line C 0.015 to 0.02 inches gap size shows good atomisation, although good atomisation is achieved at lower values than 0.015 inches and above 0.02 inches, but as discussed above, these values are not suitable for light-up conditions. Thus a gap size ranging from 0.015 to 0.02 inches satifies the three conditions of light-up, idle and high power better than other values.

In operation the six flows from the orifices 128 form a more or less annular flow of fuel which spirals along the surface 129 toward the downstream end of the body 121. Without the sleeve 130, this flow would be irregular, and in particular it would have areas of greater fuel depth corresponding with each of the six orifices 128, thus leading to irregularities in the fuel spray eventually produced. When the sleeve 130 is present and the gap 131 is chosen in accordance with the invention, the gap is such as to deform the areas of greater fuel depth to produce a more uniform film of fuel.

This flow proceeds downstream along the gap 131 since it cannot travel in the opposite direction due to the shape of the annular sleeve 121. The annular sleeve terminates substantially halfway between the position of the orifices 128 and the downstream end of the central body 121, and the fuel continues to travel down the surface 129 in the form of a thin rotating annulus of substantially constant thickness, for example approximately 6 to 8 thousandths of an inch in this region. At the downstream end of the central body 121 this annulus of fuel breaks away from the edge of the surface 129 between the flows of compressed air passing through the flow passage 123 and through the interior of the central body 121 and deflected outwardly by the deflector 133, and the shearing effect between these two flows causes atomisation of the fuel into a substantially conical shape with a level of atomisation superior to that realised when the annular sleeve 130 is absent.

Whilst the surface 129 has been shown to be parallel to the axis 101, the actual passage bounded by the surface 129 could converge, thus assisting the combination of any separate flows of fuel along the surface 129 into a single annular flow, always provided that the area of the passage between the surface 129 and sleeve 130 is not allowed to become less than the combined area of the passages 124.

It was mentioned above that the controlling flow area for the fuel flow in the injector is arranged to be provided by the orifices 128. This is important because if the gap 131 is allowed to become the controlling area it is necessary for good performance that the gap be precisely annular to a degree inpossible at present to achieve in manufacture.

It should be understood that a number of variations of the device could be made up of various different combinations of parts, and there could be provided additional fuel or other liquid injection means, for instance as a pilot fuel injection arrangement.

What I claim is:

1. A fuel injector for a gas turbine engine comprising a hollow central body, an outer body which at least partly surrounds the central body and defines a flow passage therewith, said flow passage and the interior of the central body being adapted to receive a supply of compressed air, a plurality of orifices in the internal surface of said central body, each said orifice communicating with a flow duct in said central body, said flow duct being adapted to supply fuel to each of said orifices, an elongate annular member located adjacent said plurality of orifices so as to define an annular gap between it and said internal surface of said central body, which gap is adapted to receive a flow of fuel through said orifices, the minimum flow area of the gap being larger than the total flow area of said orifices so that the gap does not provide a flow controlling orifice for the fuel flow and the radial width of the gap having a value of 0.015 to 0.02 inches whereby it deforms the separate flows from said orifices into a substantially single annular flow of generally uniform thickness.

2. A fuel injector according to claim 1 wherein the radial width of the gap is substantially 0.016 inches.

3. A fuel injector as claimed in claim 1 and in which said fuel orifices are arranged to be the flow-controlling orifices in the said flow path through said injector.

4. A fuel injector as claimed in claim 3 in which said fuel orifices lie with their center lines in a plane perpendicular to said injector axis and make an acute angle with said internal surface of said central body.

5. A fuel injector as claimed in claim 4 in which said fuel orifices are of rectangular cross-section.

6. A fuel injector as claimed in claim 4 in which said interior of said hollow central body is of substantially cylindrical shape.

7. A fuel injector as claimed in claim 4 in which part of said interior of said hollow central body converges in the direction of the flow.

8. A fuel injector as claimed in claim 3 in which said annular member extends only part way to the downstream end of said hollow central body.

9. A fuel injector as claimed in claim 1 comprising an air deflector member, said deflector member being within said hollow central body.

* * * * *